US005823402A

United States Patent [19]

Moyer et al.

[11] Patent Number: 5,823,402

[45] Date of Patent: Oct. 20, 1998

[54] FLUID DISPENSING SYSTEM

[76] Inventors: Daniel C. Moyer; Robert W. Moyer, both of 115 Arthur St., Kittanning, Pa. 16201

[21] Appl. No.: 764,063

[22] Filed: Nov. 6, 1996

[51] Int. Cl.[6] ..... B67D 5/40; B67D 5/58

[52] U.S. Cl. ..... 222/383.1; 222/333; 222/385; 222/189.1

[58] Field of Search ..... 222/189.1, 333, 222/383.1, 385

[56] References Cited

U.S. PATENT DOCUMENTS

| | | | |
|---|---|---|---|
| 3,726,443 | 4/1973 | Harris | 222/333 |
| 4,592,575 | 6/1986 | Hughes et al. | 285/252 |
| 4,801,088 | 1/1989 | Baker | 222/333 |
| 5,100,058 | 3/1992 | Wei | 222/333 |
| 5,120,438 | 6/1992 | Nakagawa et al. | 222/189.1 |
| 5,310,089 | 5/1994 | Hudgins | 222/333 |
| 5,483,799 | 1/1996 | Dalto | 62/3.7 |

*Primary Examiner*—Andres Kashnikow
*Assistant Examiner*—Keats Quinalty

[57] ABSTRACT

A fluid dispensing system for transferring a fluid from a container to a reservoir includes a container, a pump, and an intake hose and an outlet hose operably coupled to the pump. The pump and the intake hose are positioned in the container and the outlet hose exits through a container cap which matingly fits the neck of the container. The power source for the system may be 12 volts DC or a battery. An intended use of the present invention is for transferring automotive windshield wiper fluid from the container of the fluid dispensing system or from an existing container to a fluid reservoir located beneath the hood of an automobile.

13 Claims, 3 Drawing Sheets

FLUID DISPENSING SYSTEM

BACKGROUND OF THE INVENTION

1. Field of the Invention

The present invention relates to liquid dispensers and more particularly pertains to a new Fluid Dispensing System for providing a convenient means for transferring a fluid from a container to a reservoir.

2. Description of the Prior Art

The use of liquid dispensers is known in the prior art. More specifically, liquid dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid dispensers include U.S. Pat. No. 4,967,935; U.S. Pat. No. 5,310,089; U.S. Pat. No. D295,022; U.S. Pat. No. 5,409,167; U.S. Pat. No. 5,425,706 and U.S. Pat. No. 5,154,317.

While these devices fulfill their respective, particular objectives and requirements, the aforementioned patents do not disclose a new Fluid Dispensing System. The inventive device includes a container, a pump, and an intake hose and an outlet hose operably coupled to the pump, wherein the pump and the intake hose are positioned in the container and the outlet hose exits through a container cap which matingly fits the neck of the container.

In these respects, the Fluid Dispensing System according to the present invention substantially departs from the conventional concepts and designs of the prior art, and in so doing provides an apparatus primarily developed for the purpose of providing a convenient means for transferring a fluid from a container to a reservoir.

SUMMARY OF THE INVENTION

In view of the foregoing disadvantages inherent in the known types of liquid dispensers now present in the prior art, the present invention provides a new Fluid Dispensing System construction wherein the same can be utilized for providing a convenient means for transferring a fluid from a container to a reservoir.

The general purpose of the present invention, which will be described subsequently in greater detail, is to provide a new Fluid Dispensing System apparatus and method which has many of the advantages of the liquid dispensers mentioned heretofore and many novel features that result in a new Fluid Dispensing System which is not anticipated, rendered obvious, suggested, or even implied by any of the prior art liquid dispensers, either alone or in any combination thereof.

To attain this, the present invention generally comprises a container, a pump, and an intake hose and an outlet hose operably coupled to the pump, wherein the pump and the intake hose are positioned in the container and the outlet hose exits through a container cap which matingly fits the neck of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Fluid Dispensing System apparatus and method which has many of the advantages of the liquid dispensers mentioned heretofore and many novel features that result in a new Fluid Dispensing System which is not anticipated, rendered obvious, suggested, or even implied by any of the prior art liquid dispensers, either alone or in any combination thereof.

It is another object of the present invention to provide a new Fluid Dispensing System which may be easily and efficiently manufactured and marketed.

It is a further object of the present invention to provide a new Fluid Dispensing System which is of a durable and reliable construction.

An even further object of the present invention is to provide a new Fluid Dispensing System which is susceptible of a low cost of manufacture with regard to both materials and labor, and which accordingly is then susceptible of low prices of sale to the consuming public, thereby making such Fluid Dispensing System economically available to the buying public.

Still yet another object of the present invention is to provide a new Fluid Dispensing System which provides in the apparatuses and methods of the prior art some of the advantages thereof, while simultaneously overcoming some of the disadvantages normally associated therewith.

Still another object of the present invention is to provide a new Fluid Dispensing System for providing a convenient means for transferring a fluid from a container to a reservoir.

Yet another object of the present invention is to provide a new Fluid Dispensing System which includes a container, a pump, and an intake hose and an outlet hose operably coupled to the pump, wherein the pump and the intake hose are positioned in the container and the outlet hose exits through a container cap which matingly fits the neck of the container.

Still yet another object of the present invention is to provide a new Fluid Dispensing System that would reduce the likelihood of spillage when transferring a liquid from a container to a reservoir.

Even still another object of the present invention is to provide a new Fluid Dispensing System that is portable and can be easily fitted to and removed from a container.

Even still another object of the present invention is to provide a new Fluid Dispensing System that offers a portable pump designed to dispense automotive windshield wiper fluid from a container into the fluid reservoir located beneath the hood of an automobile. In such an application, the present invention provides a convenient means for transferring the fluid to a fluid reservoir which cannot be easily reached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
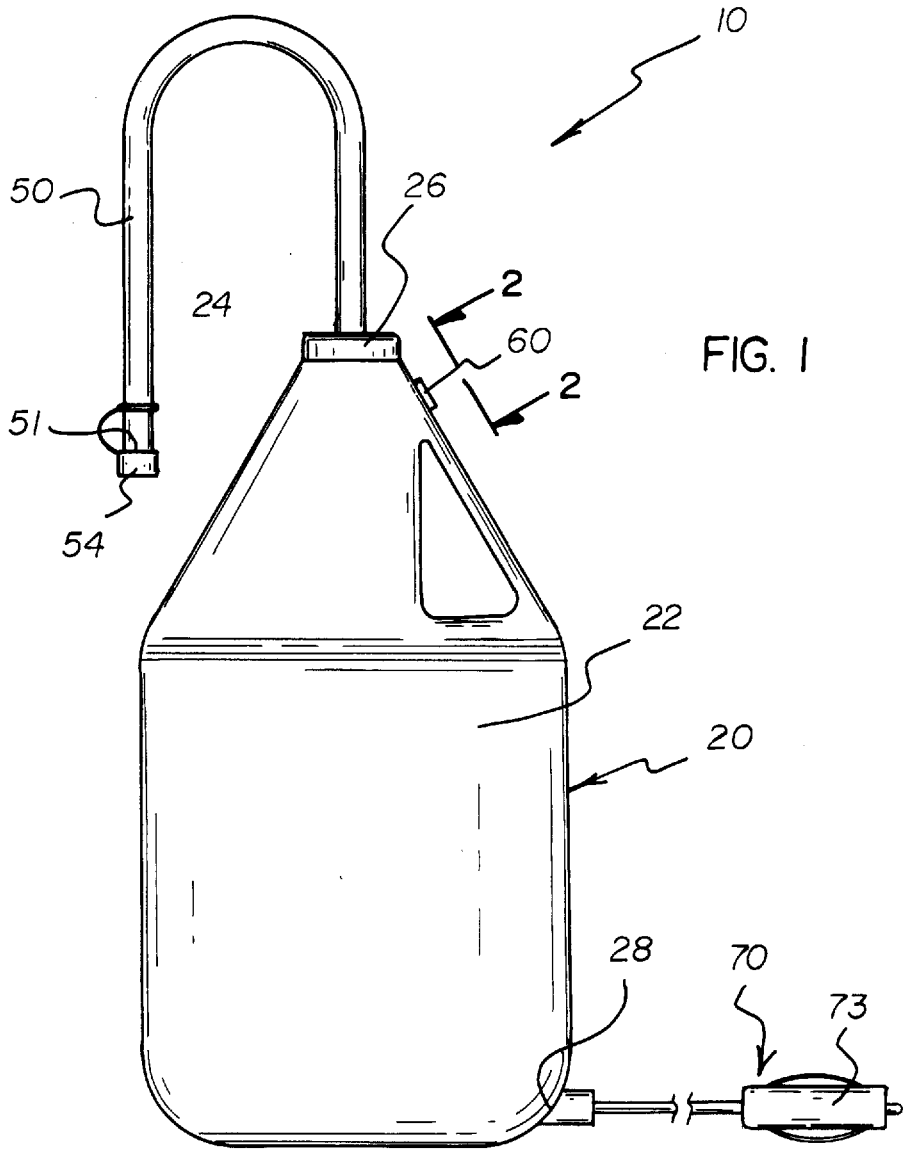
FIG. 1 is an illustration of a first embodiment of a new Fluid Dispensing System installed on a container according to the present invention.

With reference now to the drawings, and in particular to FIGS. 1 through 6 thereof, a new Fluid Dispensing System embodying the principles and concepts of the present invention and generally designated by the reference numeral 10 will be described.

More specifically, it will be noted that the Fluid Dispensing System 10 comprises a container 20, a pump 30, and an intake hose 40 and an outlet hose 50 operably coupled to the pump 30, wherein the pump 30 and the intake hose 40 are positioned in the container 20 and the outlet hose 50 exits through a container cap 26 which matingly fits the neck 24 of the container 20.

Figure 5:
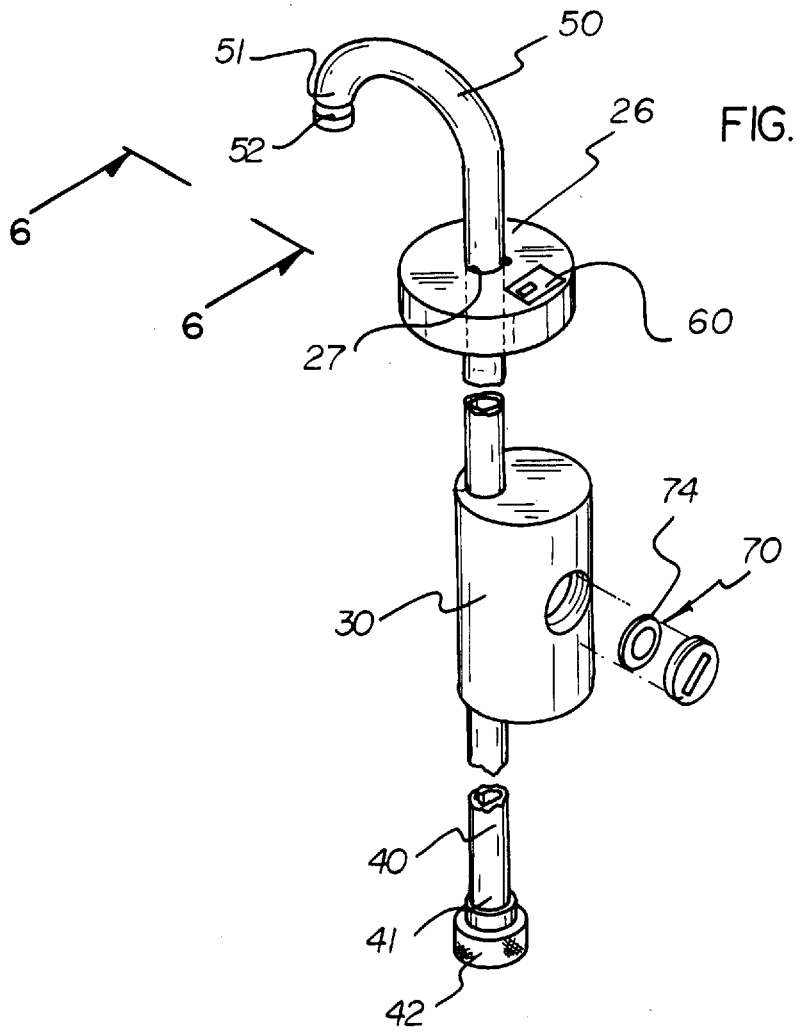
FIG. 5 is an illustration of a second embodiment of a new Fluid Dispensing System according to the present invention.
Figure 6:
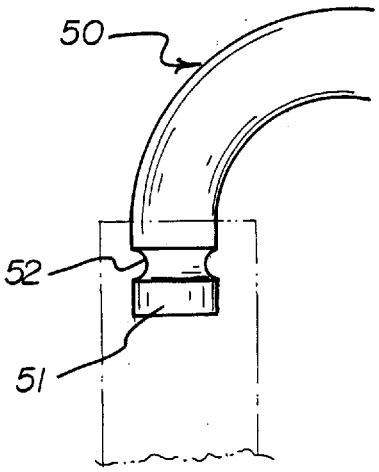
FIG. 6 is an illustration of the outlet end of the outlet hose of the present invention from the perspective of line 6—6 of FIG. 5.

As best illustrated in FIGS. 1 through 4, it can be shown that the container 20 has an outer surface 22 and a neck 24. A container cap 26 is provided which matingly fits on the neck 24 of the container 20. The container cap 26 and the neck 24 of the container 20 are provided with mating threads. The container cap 26 has a hole 27 therethrough through which the outlet hose 50 is fitted. The intake hose 40 is provided with a pickup screen 42 at the intake end 41, while the outlet hose 50 is provided with a hose cap 54 on the outlet end 51. Both the intake hose 40 and outlet hose 50 are flexible. As best illustrated in FIGS. 5 and 6, it can be shown that a groove 52 may be provided adjacent the outlet end 51 of outlet hose 50 to facilitate securing an additional section of hose to the outlet hose 50.

Figure 2:
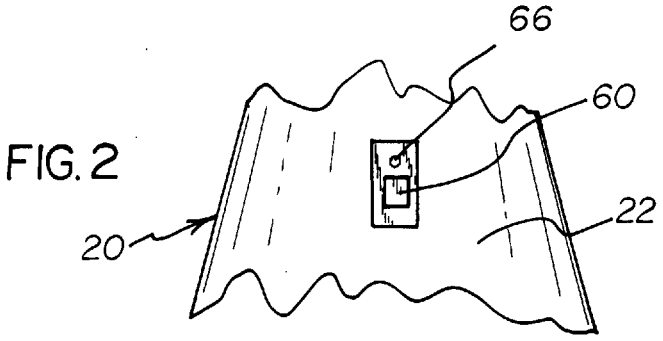
FIG. 2 is an illustration of the control switch of the present invention from the perspective of line 2—2 of FIG. 1.
Figure 3:
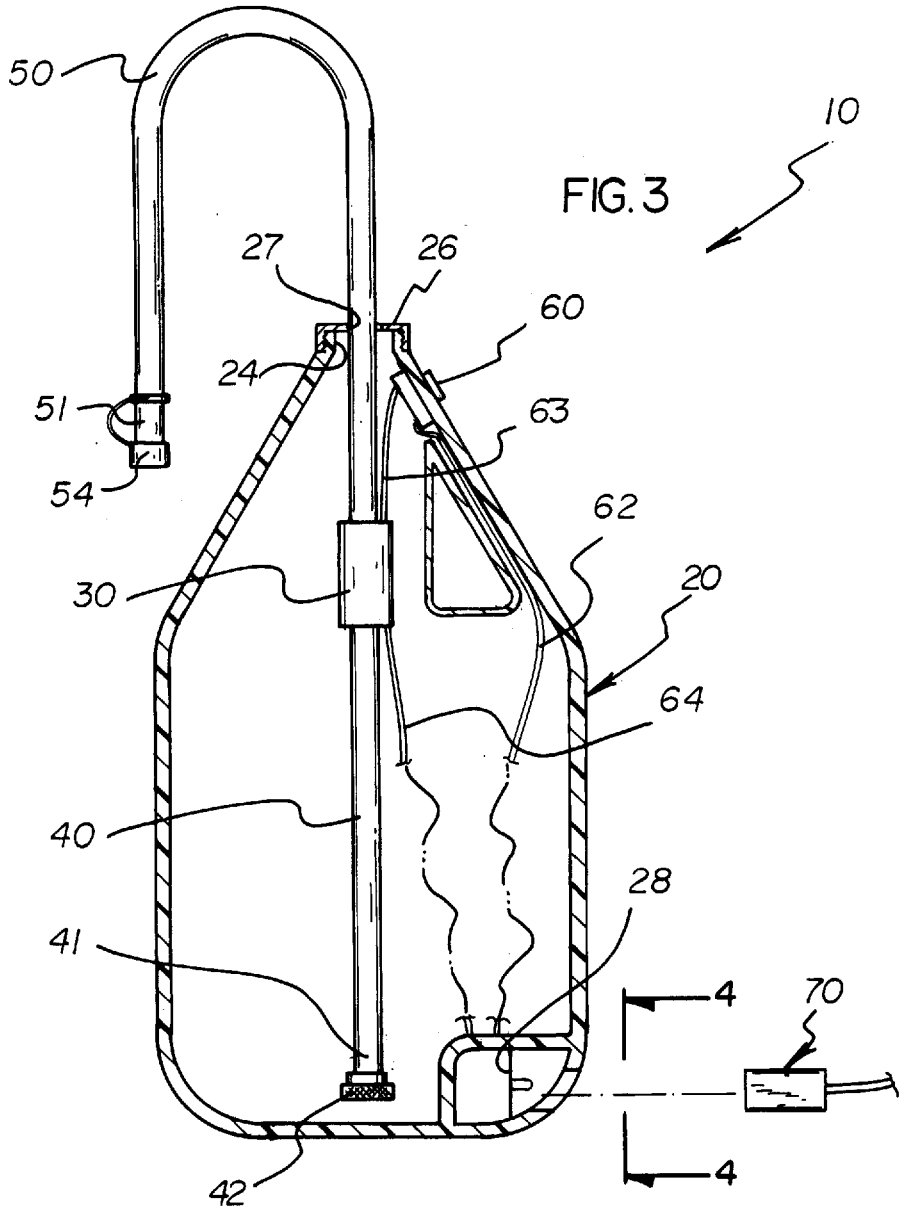
FIG. 3 is a cross sectional view of the container of the present invention showing the pump and the intake hose positioned in the container.
Figure 4:
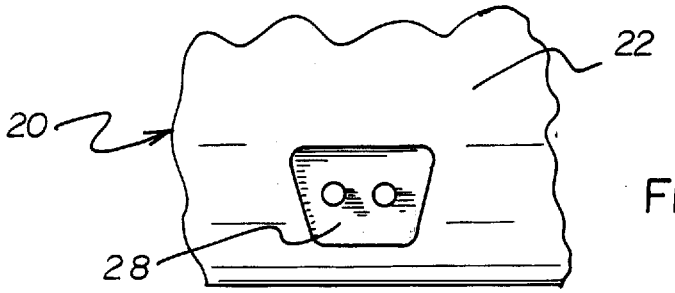
FIG. 4 is an illustration of the power source port of the present invention from the perspective of line 4—4 of FIG. 3.

As best illustrated in FIGS. 1 and 2, it can be shown that a control switch 60 is mounted on the outer surface 22 of the container 20 for activating the pump 30. The control switch 60 includes a light emitting diode (LED) power indicator 66 which is lit when power is supplied to the system 10. A remote switch (not shown) may be provided which allows an individual to operate the system 10 by foot.

To supply power for the pump 30, a power source 70 is provided. In a first embodiment, as best illustrated in FIGS. 1 through 4, it can be shown that a power source port 28 is provided in the container 20 for coupling of the power source 70 to the system 10. Electrical leads 62, 63, and 64 interconnect the pump 30, the control switch 60, and the power source 70. In the first embodiment, the power source 70 is 12 volts DC. A cigarette lighter adapter 73 may be used to supply the 12 volts DC. In a second embodiment, as best illustrated in FIGS. 5 and 6, it can be shown that the power source 70 is a battery 74.

In a first embodiment, the container 20 is filled with the fluid desired to be transferred to a remote reservoir (not shown). The intake hose 40 and the pump 30 are inserted into the container 20 and the container cap 26, with the outlet hose 50 running through the hole 27 in the container cap 26, is fit onto the neck 24 of the container 20. The outlet end 51 of the outlet hose 50 is positioned in the reservoir to be filled and the pump 30 is activated by the control switch 60. The pump 30 draws fluid from the container 20 into the intake end 41 of the intake hose 40 and pumps the fluid out the outlet end 51 of the outlet hose 50. Once the reservoir is filled to the desired level, the pump 30 is deactivated via the control switch 60.

In a second embodiment, the foreign cap of a foreign container (not shown) is removed. The intake hose 40 and the pump 30 are inserted into the foreign container and the container cap 26 of the present invention, with the outlet hose 50 running through the hole 27 in the container cap 26, is fit onto the foreign neck of the foreign container. The process outlined above is then followed to transfer fluid from the foreign container to the reservoir.

An intended use of the present invention is for transferring automotive windshield wiper fluid from the container 20 of the present invention (as suggested in the first embodiment) or a foreign container (as suggested in the second embodiment) to a fluid reservoir located beneath the hood of an automobile.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable fluid dispensing system totable by the hand of the user during operation of said fluid dispensing system said system comprising:

a container having an integral handle and a neck, said container defining an interior;

a container cap having a hole therethrough, said container cap matingly fitting on said neck of said container;

a pump located in the interior of said container;

an intake hose operably coupled to said pump, said pump and said intake hose positioned in said container;

an outlet hose operably coupled to said pump, said outlet hose exiting said container through said hole in said container cap;

a control switch for activating said pump, said control switch being mounted on said container in a position proximate to said handle such that said control switch can be manipulated by a finger of a hand of a user while said hand grips said handle of said container.

2. The fluid dispensing system of claim 1, wherein said intake hose has an intake end and further comprising a pickup screen provided at said intake end of said intake hose.

3. The fluid dispensing system of claim 1, wherein said outlet hose has an outlet end and further comprising a hose cap provided at said outlet end of said outlet hose.

4. The fluid dispensing system of claim 1, wherein said outlet hose has a groove therein adjacent said outlet end of said outlet hose to facilitate securing a dispensing hose to said outlet hose.

5. The fluid dispensing system of claim 1, further comprising a light emitting diode power indicator, said light emitting diode power indicator being lit when power is supplied to the system.

6. The fluid dispensing system of claim 1, wherein said integral handle comprises a loop integrally formed in the wall of said container.

7. The fluid dispensing system of claim 1, wherein said power source is 12 volts DC.

8. The fluid dispensing system of claim 7, further comprising a cigarette lighter adapter, said cigarette lighter adapter supplying the 12 volts DC.

9. The portable fluid dispensing system of claim 1, further comprising:

a power port for powering said pump, said power port being mounted on and passing through a wall of said container, an exterior portion of the power port being connectable to a power source.

10. The portable fluid dispensing system of claim 9, further comprising:

a connection means for electrically connecting said power port, said control switch and said pump, said connection means being located in the interior of said container.

11. The fluid dispensing system of claim 1, wherein said integral handle being located adjacent to a top of said container to enhance the stability of said container in the handgrip of the user when the interior of said container is filled with liquid.

12. The fluid dispensing system of claim 11, wherein said integral handle is located in a top half of the container.

13. A fluid dispensing system comprising:

a container having an integral handle, a neck, and an exterior surface, said exterior surface being structured to form a recessed portion proximate a base of said container;

a container cap having a hole therethrough, said container cap matingly fitting on said neck of said container;

a pump having a primary power source;

an intake hose operably coupled to said pump, said pump and said intake hose positioned in said container;

an outlet hose operably coupled to said pump, said outlet hose exiting said container through said hole in said container cap;

a control switch for activating said pump, said control switch positioned proximate said handle for facilitating simultaneous manipulation of said switch while holding said handle;

a power port leading from an inside said container to an outside of said container, said power port being positioned within said recessed portion of said container;

a secondary power source for powering said pump, said secondary power source being connectable to said power port;

a connection means for electrically connecting said power port, said control switch and said pump, said connection means being positioned entirely within said container;

wherein said intake hose has an intake end and further comprising a pickup screen provided at said intake end of said intake hose;

wherein said outlet hose has an outlet end and further comprising a hose cap provided at said outlet end of said outlet hose;

wherein said outlet hose has a groove therein adjacent said outlet end of said outlet hose to facilitate securing a dispensing hose to said outlet hose;

a light emitting diode power indicator, said light emitting diode power indicator being lit when power is supplied to the system.

* * * * *